US005291635A

United States Patent [19]

Schmale

[11] Patent Number: 5,291,635

[45] Date of Patent: Mar. 8, 1994

[54] DEVICE FOR LIMITING THE SET-UP ANGLE BETWEEN TWO PLANAR COMPONENTS

[75] Inventor: Karl E. Schmale, Lüdenscheid, Fed. Rep. of Germany

[73] Assignee: Schmale GmbH & Co. KG, Lüdenscheid, Fed. Rep. of Germany

[21] Appl. No.: 768,665

[22] PCT Filed: Jan. 10, 1991

[86] PCT No.: PCT/DE91/00016

§ 371 Date: Oct. 3, 1991

§ 102(e) Date: Oct. 3, 1991

[87] PCT Pub. No.: WO91/11585

PCT Pub. Date: Aug. 8, 1991

[30] Foreign Application Priority Data

Feb. 3, 1990 [DE] Fed. Rep. of Germany ..... 9001206
Feb. 28, 1990 [DE] Fed. Rep. of Germany ..... 9002325
Oct. 23, 1990 [DE] Fed. Rep. of Germany ..... 9014646

[51] Int. Cl.[5] ..... E05D 11/06; A47G 1/14

[52] U.S. Cl. ..... 16/371; 40/152.1; 16/343

[58] Field of Search ..... 16/371, 366, 343, 345, 16/375; 40/152, 152.1, 120, 155

[56] References Cited

U.S. PATENT DOCUMENTS 481,492 8/1892 Hirst ..... 16/345
790,483 5/1905 DeMartini ..... 16/345
1,093,843 4/1914 Gassaway ..... 16/345
1,766,197 6/1930 Shepard ..... 16/343
1,798,267 3/1931 Marsh .
2,200,699 5/1940 McNulty .
2,456,720 12/1948 Miles ..... 40/152.1
2,811,741 11/1957 Miller et al. .
2,831,285 4/1958 Cross ..... 40/152.1

FOREIGN PATENT DOCUMENTS 35063 4/1886 Fed. Rep. of Germany .
8809422 1/1989 Fed. Rep. of Germany .
329588 8/1903 France .
1424043 11/1965 France .
5050 3/1916 United Kingdom .
348370 6/1931 United Kingdom .
2079361 1/1982 United Kingdom .

*Primary Examiner*—Lowell A. Larson
*Assistant Examiner*—Michael J. McKeon
*Attorney, Agent, or Firm*—Spencer, Frank & Schneider

[57] ABSTRACT

The device serves to delimit a set-up angle between two planar components which are connected with one another by means of a hinge (1, 2), for example between the picture cover (3) of a picture frame and a supporting base (4). The device is characterized by a connecting web (8) which at one end is provided with one half of a hinge base joint (54) and at the other end is configured as a T-shaped member (89). The other half of the hinge base joint can be fastened to one of the two planar components—the picture cover (3). The T-shaped member (89) grips behind a cutout (23) in a plate that can be fastened to the other planar component—the supporting base (4). The width of the cutout (23) in the region facing the hinge (1, 2) is greater than the width of the transverse portion (80) of the T-shaped member (89). A step (30) is provided at the transition from the narrower to the broader region.

13 Claims, 10 Drawing Sheets

DEVICE FOR LIMITING THE SET-UP ANGLE BETWEEN TWO PLANAR COMPONENTS

BACKGROUND OF THE INVENTION

1. Technical Field

The invention relates to a device for limiting the set-up angle between two planar components which are connected with one another by way of a hinge, for example between the picture cover of a picture frame and its supporting base.

2. State of the Art

Picture frame hinges are known which have a supporting base (U.S. Pat. No. 2,811,741; DE-U-8,809,422) in which two hinge leaves are connected with one another at their abutting edges by way of a hinge joint formed of knuckles through which passes a hinge wire. The angle limitation required for setting up the picture frame with the aid of the supporting base is determined by stops which are either formed as axial projections at the knuckles of the one hinge leaf and as matching axial recesses in the knuckles of the other hinge leaf or are provided along the knuckles of the one hinge leaf over the entire length of the knuckles, with the other hinge leaf abutting thereon when the picture frame is set up. In the prior art hinges there exists the danger that, under greater stresses as they may easily result from improper set-up of the picture frame, the hinges are damaged in the region of the stops and/or, if the picture frames are heavy, the supporting base is bent.

SUMMARY OF THE INVENTION

This is where the present invention intends to come to the aid. Based on the described use, it is generally the object of the invention to configure a device of the above-mentioned type so that, while avoiding stops in the hinge, a stable limitation is provided for the set-up angle between the two planar components, for example the supporting base relative to the picture cover of the picture frame. According to the invention, this is accomplished by a connecting web which, at one end, is provided with one half of the hinge base joint, whose other half can be fastened to one of the two components—the picture cover—and which, at its other end, has a T-member configuration that engages behind a cutout provided in a plate that can be fastened to the other component—the supporting base—with the width of the cutout in the region facing the hinge being greater than the width of the transverse portion of the T-shaped member. A stop is provided at the transition from the narrower to the broader region.

In the invention, stops are avoided in the region of the hinge. Rather, the set-up angle is determined by the length of the connecting web and the angle which it forms with the planar components. The set-up angle is selectable within limits. The set-up angle between the planar components, for example between a picture frame and its set-up base, does not change even if the one component should be pushed away from the other component beyond the set-up angle. The connecting web is supported at the other component. The set-up angle is thus fixed; the components will not spring away from one another. If the components are folded together, the connecting web lies between the two components essentially parallel thereto. The entire thickness of the device in the folded together state is held within limits, a flat support in close proximity to one another is ensured.

The device permits the use of thin materials which ensure a non-bulky construction and their concealed attachment. There is no loss of stability.

If the device is to be minimized, in particular, to be configured s that the thickness of the hinge is further reduced, thus saving material, this is accomplished, as a modification of the invention, in that the connecting web is provided with at least one shoulder. This shoulder additionally stabilizes the connecting web and thus the entire device according to the invention. It is therefore possible to reduce the thickness of the hinge without loosing its—original—stability.

In addition to the mentioned use of the device according to the invention for pictures, it is possible to use it for any type of upright displays, for example, racks, signs or boards.

Features and modifications of the invention are defined in the dependent claims.

BRIEF DESCRIPTION OF THE DRAWINGS

Embodiments of the invention are illustrated in the drawings and will now be described in detail. It is shown in.

Figure 1B:
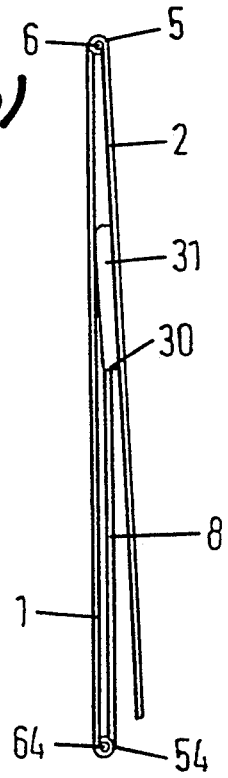
FIGS. 1*a*, 1*b*, 1*c* a device in the form of a hinge having a connecting web articulated to the base of one of the hinge leaves.

(b) In FIGS. 1*b*, 2*b*, 4*b* and 7*b*–10*b* a front view of the entire hinge in the closed state;

(c) in FIGS. 1*c*, 2*c*, 3*b*, 4*c*, 5*b*, 6*b* and 7*c*–10*c* the hinge shown in the open state.

DETAILED DESCRIPTION OF THE PREFERRED EMBODIMENTS

By way of a hinge, two planar components are connected with one another so as to limit their set-up angle. The hinge includes two hinge leaves 1 and 2. Hinge leaf 1 is fastened to the rear picture cover 3 of a picture frame which, in the embodiments, constitutes the one planar component; hinge leaf 2 is fastened to a supporting base 4 of the picture frame which constitutes the other planar compound—shown only in FIGS. 1*c* and 7*c*. At their abutting edges, hinge leaves 1, 2 are configured as knuckles 11, 21. Knuckles 11, 21 form hinge knuckles 5. A hinge wire 6 passes through hinge knuckles 5. Together with hinge wire 6, hinge knuckles 5 form a hinge joint. In order to form the hinge joint 5, 6, knuckles 11 of the one hinge leaf 1 mesh in the manner of a comb with knuckles 21 of the other hinge leaf 2.

Spaced from knuckles 11, 21, claws 12, 22 or beads 10,20 are provided at each hinge leaf 1, 2. With the aid of claws 12 or beads 10 on the one hinge leaf 1, the device is fastened to picture cover 3 by driving it into the picture cover or inserting it as a component of a plug-in detent connection; with the aid of the claws 22 or beads 20 of the other hinge leaf 2, it is fastened to supporting base 4.

A connecting web 8 is articulated to hinge leaf 1. Connecting web 8 is formed by a delimiting leg 82 and a delimiting hook 88 which change into one another. The length of connecting web 8 is proportional to the set-up angle of the hinge. With the hinge open—in the drawing figures in each case at letter (c)—connecting web 8 is disposed at an angle to hinge leaf 1 and is supported at the other hinge leaf 2. With the hinge closed—in the drawing figures in each case at letter (b)—connecting web 8 has been pivoted into a position essentially parallel to the first hinge leaf 1.

At its free edge, hinge leaf 1 is provided with knuckles 14 which form one half of a base hinge joint 54. The other half is either also composed of knuckles 84—FIGS. 1 to 9—which are shaped onto delimiting leg 82, with knuckles 14, 84 being penetrated by a hinge wire 64. Or, hinge pins 85 are shaped onto both transverse sides of delimiting leg 82 so as to engage in knuckles 14—FIG. 10. Knuckles 14 are formed either at the free edge of hinge leaf 1—FIGS. 1, 2, 4, 7, 8 and 9—or at a plate 7—FIGS. 3, 5 and 6.

At the end of connecting web 8 opposite to base hinge joint 54, delimiting hook 88 is configured as a T-shaped member 89. T-shaped member 89 grips behind a cutout 23 formed in the other hinge leaf 2 or in a further plate 9. In the region 24 facing hinge joint 5, 6, the width of cutout 23 is smaller and in the region 27 facing away from it, it is larger than the width of the transverse portion 80 of T-shaped member 89. At the transition from the narrow region 24 to the broad region 27, a stop 30 is provided. The narrow region 24 of cutout 23 is provided in a groove 31 which is pressed into the other hinge leaf 2 or into plate 9 in the direction of the one hinge leaf 1. This hinge leaf 1 may be provided with a cutout which is congruent with the size of groove 31.

Figure 1A:
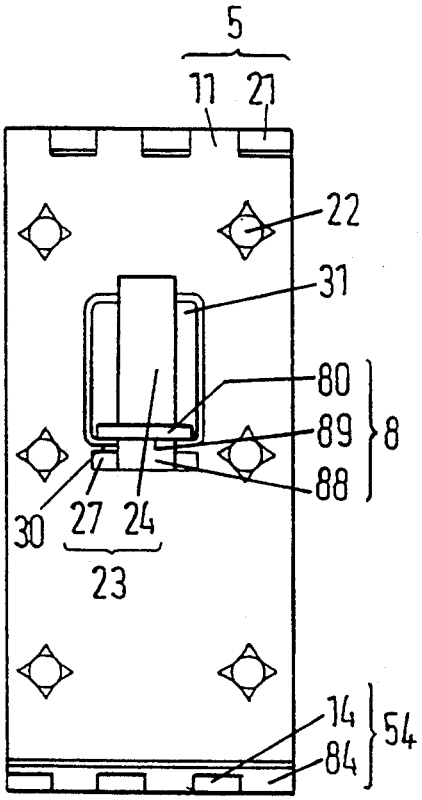
Figure 1C:
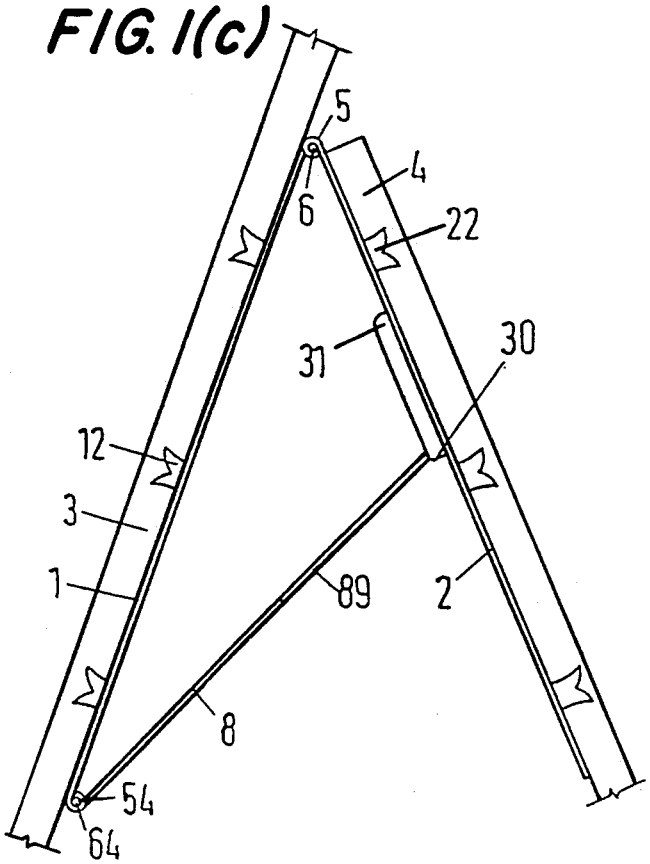
Figure 2B:
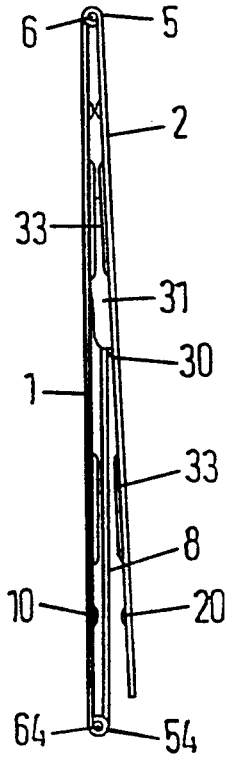
FIGS. 2*a*, 2*b*, 2*c* a device analogous to FIG. 1 equipped with additional reinforcing beads.
Figure 2A:
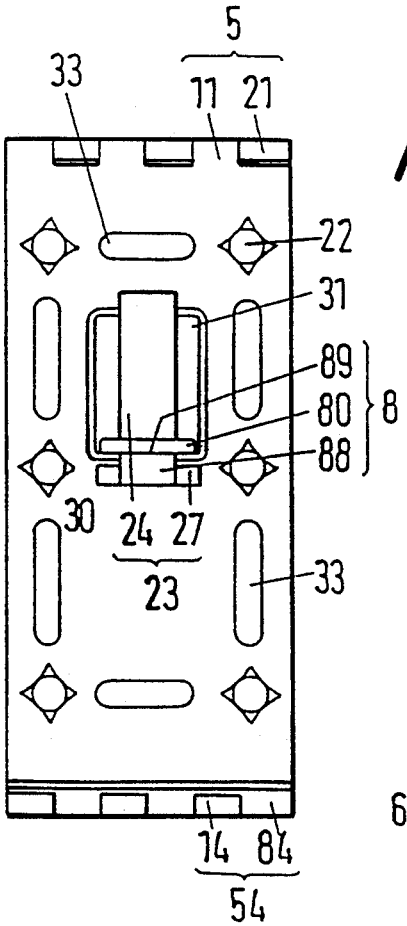
Figure 2C:
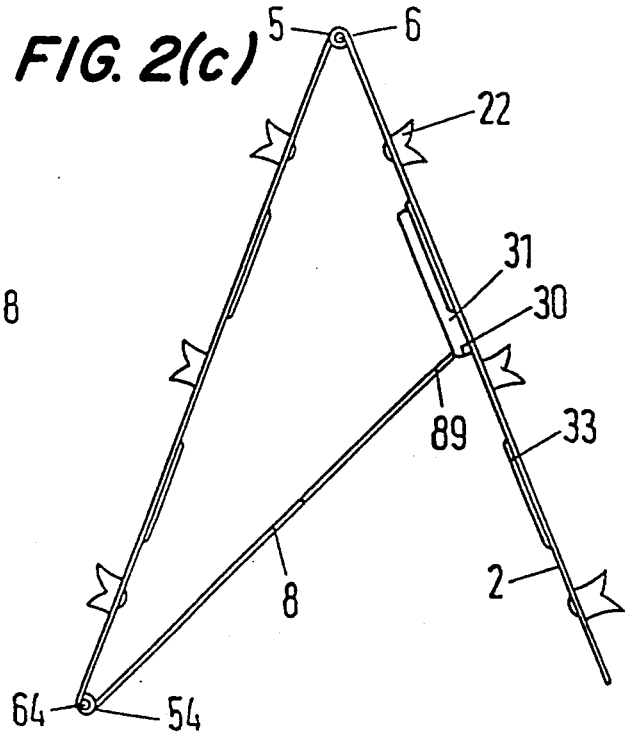

In the embodiment shown in FIG. 1, hinge leaves 1, 2 are relatively long and broad. This eliminates the need for separate reinforcements at the planar components, in the embodiment at picture cover 3 and supporting base 4. Groove 31 is part of hinge leaf 2. The one part of hinge base joint 54 is part of the one hinge leaf 1. In the embodiment shown in FIG. 2, reinforcing beads 33 are provided in hinge leaves 1, 2 for additional stabilization. In the embodiment shown in FIG. 4, hinge leaves 1, 2 and thus also connecting web 8 are comparatively short.

Figure 3B:
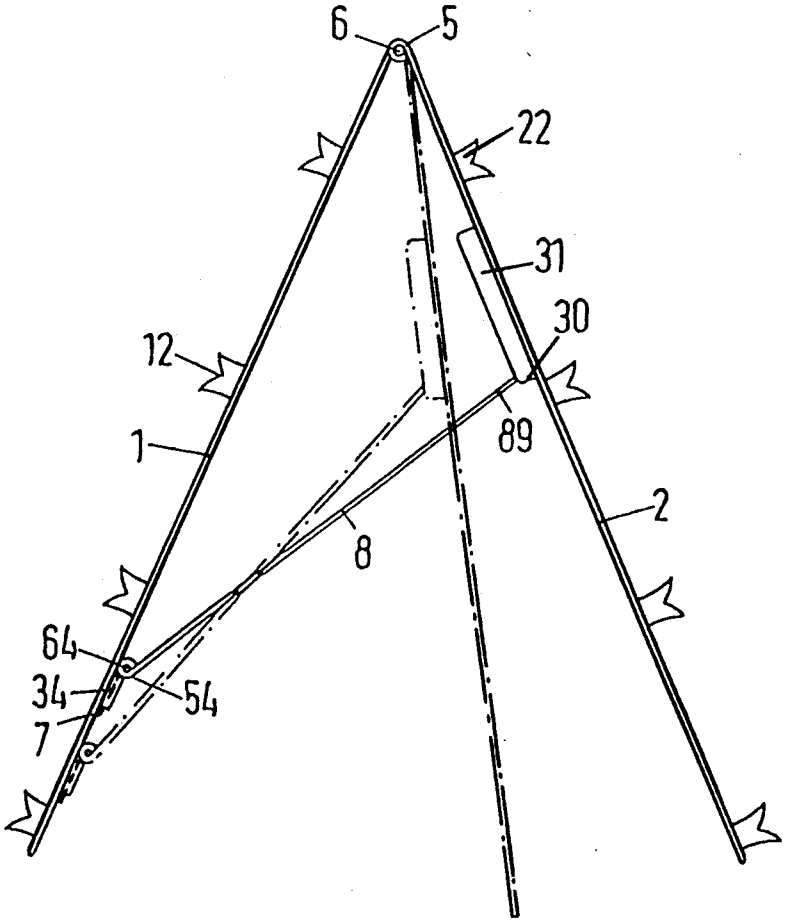
FIGS. 3*a*, 3*b* a device analogous to FIG. 1 equipped with an adjustable articulating axis for the connecting web.
Figure 3A:
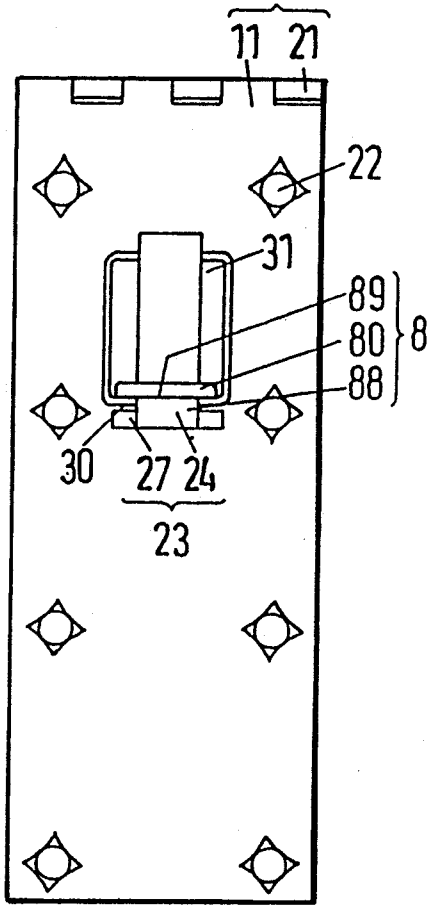
Figure 4B:
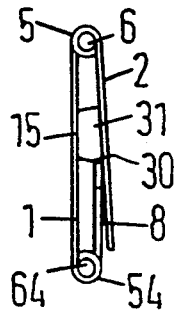
FIGS. 4*a*, 4*b*, 4*c* a device analogous to FIG. 1 equipped with short hinge leaves.
Figure 4A:
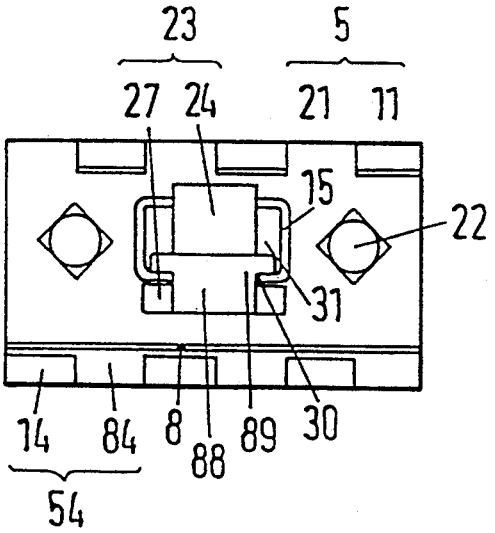
Figure 4C:
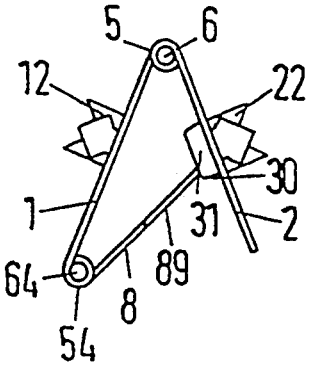

In the embodiment shown in FIG. 3 as well, groove 31 is a component of hinge leaf 2. The other half of the hinge base joint, however, is formed at plate 7 which is fastened to hinge leaf 1 as a component separate from hinge 1, 2. The fastening is effected by way of a plug-in detent connection. For this purpose, the interior of hinge leaf 1 is provided with pockets 34 at different distances from hinge joint 5, 6 into which plate 7 is inserted and held by means of beads 20. The setting of different set-up angles—shown in dash-dot lines in FIG. 3—is possible by selection of the pocket 34 into which plate 7 is inserted.

Figure 5A:
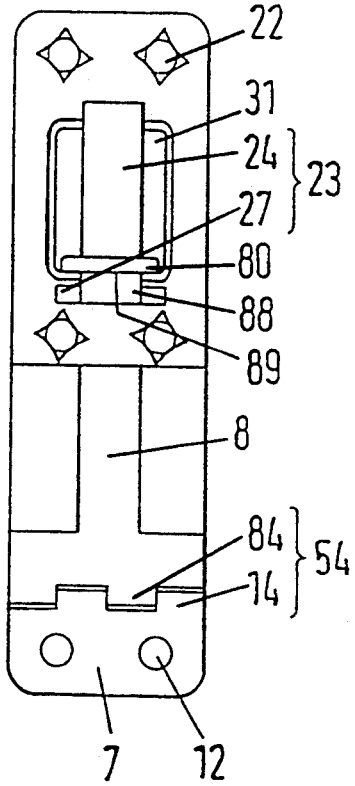
FIGS. 5*a*, 5*b* a device in which the connecting web is stoppable when it is released from a hinge.
Figure 5B:
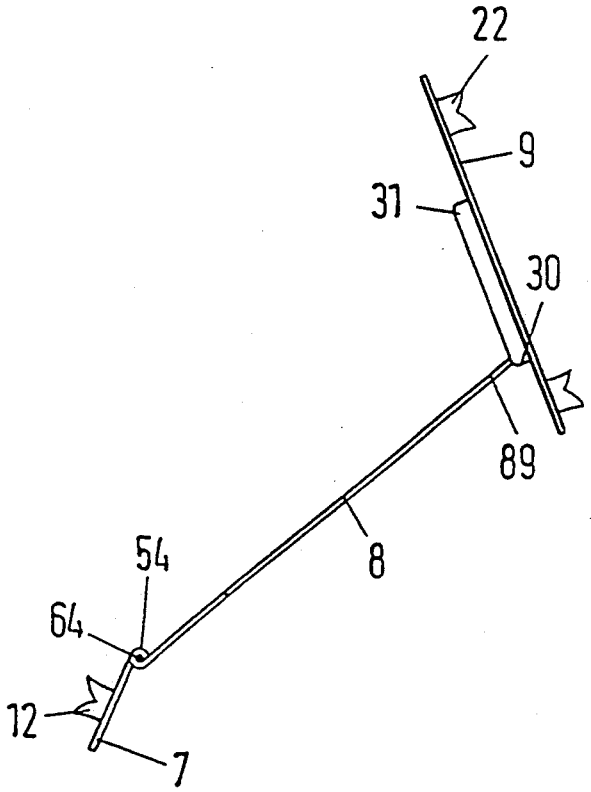
Figure 6A:
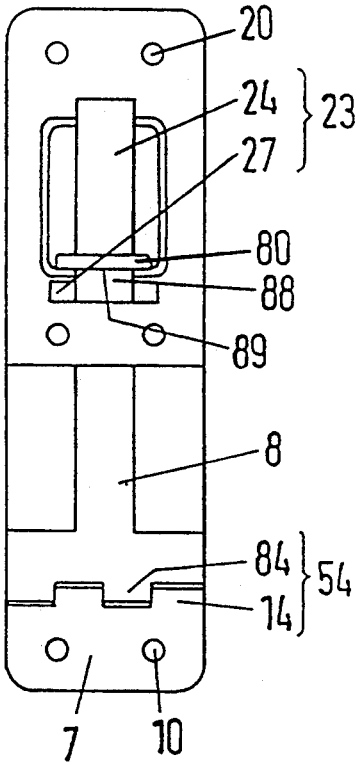
FIGS. 6*a*, 6*b* a device in which the connecting web is insertable when released from a hinge.
Figure 6B:
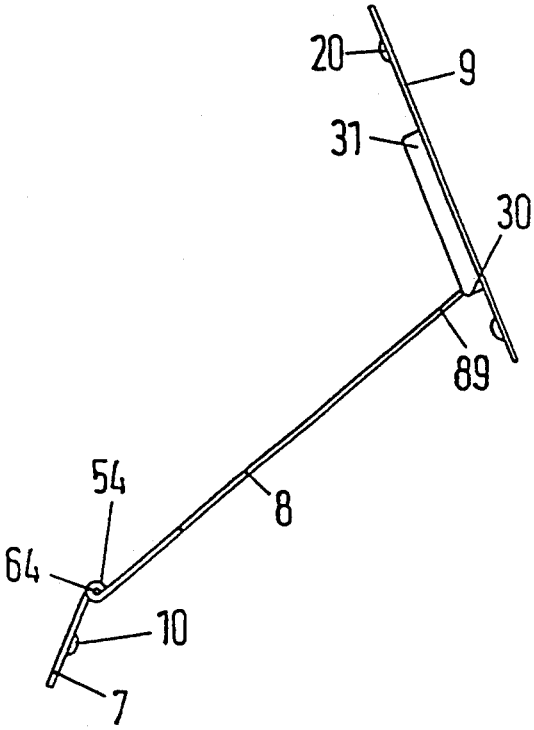
Figure 7A:
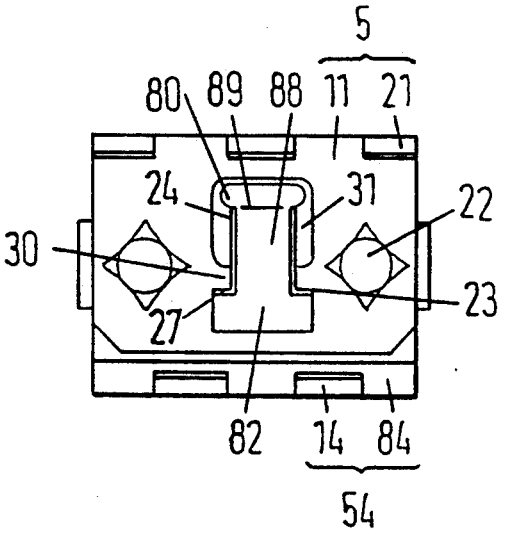
FIGS. 7*a*, 7*b*, 7*c* a device analogous to FIG. 1 equipped with a shoulder at its connecting web.
Figure 7B:
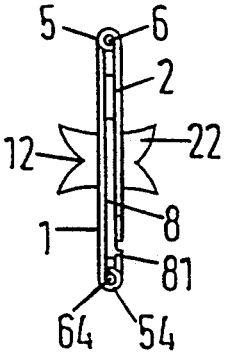
Figure 7C:
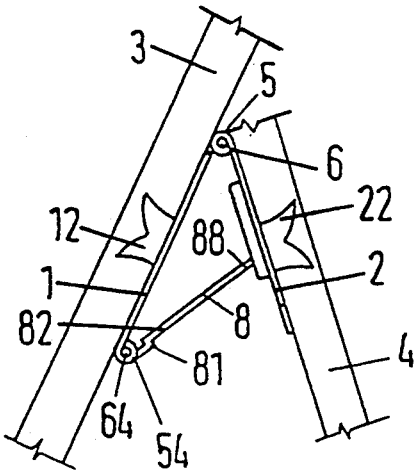
Figure 8A:
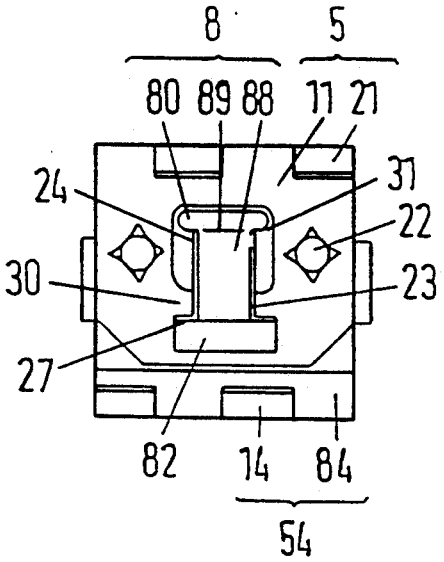
FIGS. 8*a*, 8*b*, 8*c* a device analogous to FIG. 7 equipped with an oppositely oriented shoulder on the connecting web.
Figure 8B:
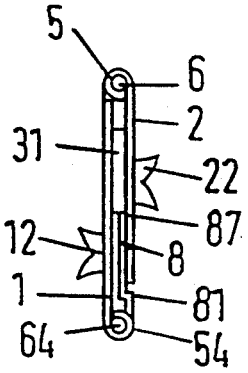
Figure 8C:
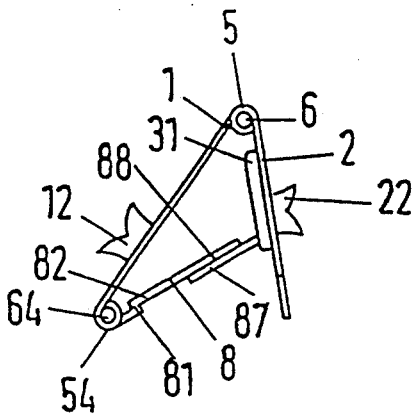
Figure 9A:
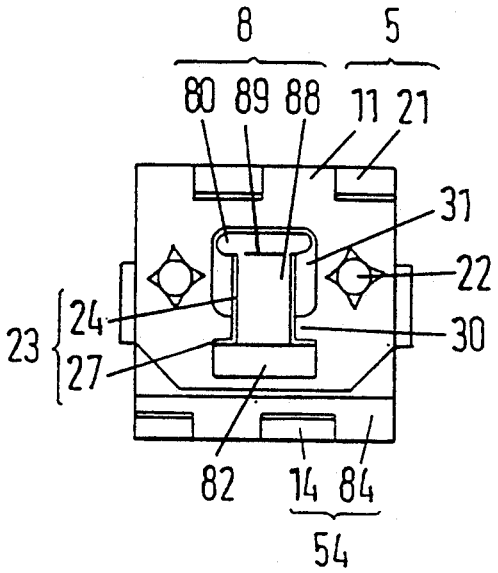
FIGS. 9*a*, 9*b*, 9*c* a device analogous to FIG. 8 equipped with additional recesses.
Figure 9B:
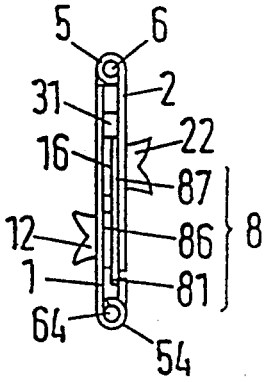
Figure 9C:
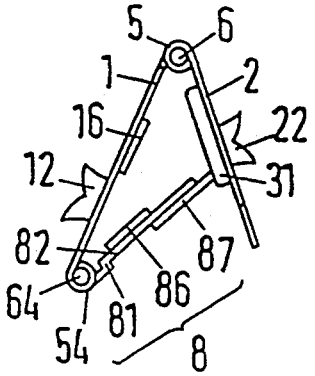
Figure 10A:
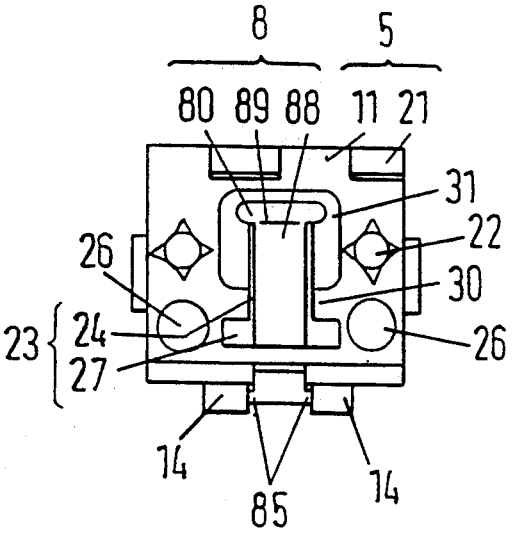
FIGS. 10*a*, 10*b*, 10*c* a device analogous to FIG. 9 equipped with hinge pins that are pressed against the connecting web, it being shown in each case in (a) In FIGS. 1*a*–10*a* a view of the entire hinge.
Figure 10B:
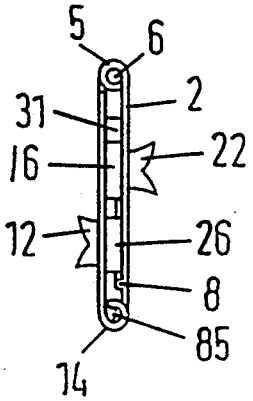
Figure 10C:
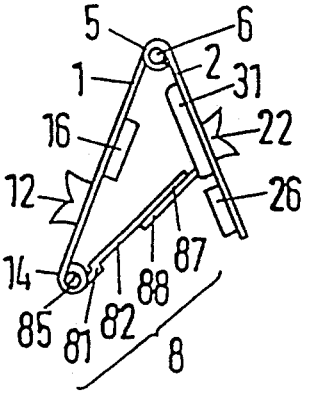

In the embodiments shown in FIGS. 5 and 6, not only is the other half of hinge base joint 54, 64 a component of plate 7, groove 31 is also a component of a further plate 9. In the embodiment shown in FIG. 5, plates 7, 9 are inserted with the aid of claws 12, 22 into the two planar components, in the embodiment into picture cover 3 and supporting base 4, which, by the way, are held so as to be pivotal relative to one another by means of a—short—hinge, not illustrated; or—analogous to FIG. 3—are inserted with the aid of beads 10, 20 and by way of a plug-in detent connection into non-illustrated pockets.

In the embodiments shown in FIGS. 7 to 10, connecting web 8 is provided with at least one shoulder 81; 87. Connecting web 8, which is formed by delimiting leg 82 that is provided with the one half of hinge base joint 54 and by delimiting hook 88 that is equipped with T-shaped member 89, is provided with oppositely directed shoulders 81; 87. Connecting web 8 and/or the other half of hinge base joint 54 and/or hinge leaf 1 are each provided with at least one protrusion 16; 26; 86 which, if the device is folded together, lies against the rear of one of the claws 12; 22.

If one assumes that a conventional hinge thickness is 2.5 mm, the use of one or more of the measures according to the invention permits a reduction of the hinge thickness to less than 2 mm down to 1.5 mm. In this case, hinge wires 6, 64 having a reduced diameter are employed to form hinge base joint 54, 64 and hinge joint 5, 6.

The embodiments of the device illustrated in the drawing figures operate as follows: the other hinge leaf 2 and connecting web 8 are pivoted toward one another from one plane until transverse portion 80 of T-shaped member 89 is disposed opposite the broader region 27 of cutout 23. T-shaped member 89 can then be pushed through cutout 23. The angle between connecting web 8 and the one hinge leaf 1 is then reduced, thus placing the transverse portion of T-shaped member 89 into groove 31. Within this groove 31, the transverse portion of T-shaped member 89 then moves perpendicularly to hinge joint 5, 6 from its one extreme position—shown in the respective Figures (b)—in which the hinge is closed, to the other extreme position—shown in the respective Figures (c)—in which the hinge is completely open. This other extreme position is determined by stop 30 which is formed between groove 31 at the end adjacent to the broader region 27 of cutout 23 and the other hinge leaf 2.

At their end faces, hinge leaves 1, 2 and/or knuckles 11, 21 may be combined with hinge leaves and knuckles of other hinges so as to form a strip-shaped workpiece. The workpiece is then brought to an attachment machine where the hinges are separated and fastened to picture cover 3 and set-up base 4. During this attachment process, protrusions 16, 26, 86 support claws 12 22 at their rear sides.

What is claimed is:

1. A device for limiting the set-up angle between first and second planar components, the device comprising:

first and second plates connected by a first hinge, for mounting respective first and second planar components thereon;

a connecting web connected at a first end to the first plate by a second hinge, the connecting web being configured at a second end as a T-shaped member for engaging a T-shaped cutout provided in the second plate, the width of the cutout in a region farthest from the first hinge being greater than the width of a transverse portion of the T-shaped member, a stop being provided at a transition from a narrow to a broad region of the cutout;

wherein at least one of the first and second plates is provided with claws for mounting a respective one of the first and second planar components thereto; and wherein at least one of the connecting web, the second plate, and the first plate, is provided with at least one protrusion which, when the device is folded together, lies against a rear portion of at least one of the claws.

2. A device according to claim 1, wherein a groove is pressed into the second plate and the narrow region of said cutout extends in the groove.

3. A device according to claim 1, wherein the second plate is separable from the first hinge, whereby the second planar component can be mounted on said second plate separated from said first plate.

4. A device according to claim 1, wherein the second plate is integral with a hinge leaf of the first hinge fastened to the second planar component.

5. A device according to claim 1, wherein said first plate is integral with a hinge leaf of the second hinge fastened to the first planar component, and wherein said first plate is separable from the first hinge, whereby the first planar component can be mounted on said first plate separated from said second plate.

6. A device according to claim 5, wherein the hinge leaf of the second hinge which is integral with the first plate, is integral with a hinge leaf of the first hinge.

7. A device according to claim 1, wherein the second hinge comprises hinge pins formed at both transverse sides of the connecting web for engaging in knuckles formed in the first plate.

8. A device according to claim 1, wherein the connecting web comprises a delimiting leg having the second hinge and a delimiting hook having the T-shaped member, both of said legs being provided with oppositely directed shoulders.

9. A device according to claim 1, wherein the second hinge comprises first knuckles formed at the first end of the connecting web and second knuckles formed in the first plate, said first and second knuckles meshing with one another in the manner of a comb and being penetrated by a hinge wire.

10. A device according to claim 1, wherein first and second hinge joints of said first and second hinges comprise knuckles and hinge wires extending in holes in the knuckles, the hinge wires being of a diameter smaller than the holes in the knuckles.

11. An assembly including a picture frame, having a planar picture cover and a planar supporting base mounted on respective first and second plates which are connected by a first hinge, and first means for limiting a set-up angle between the picture cover and the supporting base, the first means comprising:

a connecting web connected at a first end with a first half of a second hinge, a second half of the second hinge being fastenable to the first plate mounting the picture cover, the connecting web at a second end thereof being a T-shaped member; and a cutout provided in the second plate through which the T-shaped member engages;

wherein a first width of the cutout in a region farthest from the first hinge is greater than the width of a transverse portion of the T-shaped member, a stop being provided at a transition between the first width and a second narrower width of the cutout;

wherein the second plate is a separate component from the first hinge and can be fastened to the supporting base separate from the assembly;

wherein the second plate is provided with fastening means for direct fastening of the second plate to the supporting base, the fastening means being in the form of claws; and wherein the connecting web and the first plate are provided with protrusions which, when the assembly is folded together, rest against respective rear portions of the claws.

12. A device for limiting the set-up angle between first and second planar components, the device comprising:

first and second plates connected by a first hinge, for mounting respective first and second planar components thereon;

a connecting web connected at a first end to the first plate by a second hinge, the connecting web being configured at a second end as a T-shaped member for engaging a T-shaped cutout provided in the second plate, the width of the cutout in a region farthest from the first hinge being greater than the width of a transverse portion of the T-shaped member, a stop being provided at a transition from a narrow to a broad region of the cutout;

wherein at least one of the first and second plates is provided with beads for plug-in detent connection with a respective one of the first and second planar components, for mounting a respective one of the first and second planar components thereto; and wherein at least one of the connecting web, the second plate, and the first plate, is provided with at least one protrusion which, when the device is folded together, lies against a rear portion of at least one of the beads.

13. A device according to claim 12, wherein the beads are provided with the at least one of the first and second plates at different distances from the first hinge.

* * * * *